US010072387B2

(12) United States Patent
Song et al.

(10) Patent No.: US 10,072,387 B2
(45) Date of Patent: Sep. 11, 2018

(54) SIDE SNOWPLOW INCLUDING LAND LEVELER

(71) Applicant: XUZHOU XUGONG ROAD-CONSTRUCTION MACHINERY CO., LTD., Xuzhou (CN)

(72) Inventors: Zonghua Song, Xuzhou (CN); Chengpeng Gu, Xuzhou (CN); Hongqiang Qi, Xuzhou (CN); Shengli Lu, Xuzhou (CN); Qingxuan Meng, Xuzhou (CN); Ju He, Xuzhou (CN); Junjie Duan, Xuzhou (CN); Yang Fan, Xuzhou (CN); Qiangda Zhang, Xuzhou (CN); Cong Xiong, Xuzhou (CN); Chaohai Chen, Xuzhou (CN); Guangdong Gong, Xuzhou (CN)

(73) Assignee: XUZHOU XUGONG ROAD-CONSTRUCTION MACHINERY CO., LTD., Xuzhou (CN)

( * ) Notice: Subject to any disclaimer, the term of this patent is extended or adjusted under 35 U.S.C. 154(b) by 0 days.

(21) Appl. No.: 15/122,606

(22) PCT Filed: Jan. 9, 2015

(86) PCT No.: PCT/CN2015/070418

§ 371 (c)(1),
(2) Date: Aug. 30, 2016

(87) PCT Pub. No.: WO2015/149574

PCT Pub. Date: Oct. 8, 2015

(65) Prior Publication Data

US 2017/0073917 A1 Mar. 16, 2017

(30) Foreign Application Priority Data

Mar. 31, 2014 (CN) ..... 2014 1 0124973

(51) Int. Cl.
*E01H 5/06* (2006.01)
*E02F 3/76* (2006.01)

(52) U.S. Cl.
CPC ..... *E01H 5/067* (2013.01); *E02F 3/7677* (2013.01); *E02F 3/7681* (2013.01); *E02F 3/7686* (2013.01)

(58) Field of Classification Search
CPC ..... E04H 5/067; E02F 3/7677; E02F 3/7681
See application file for complete search history.

(56) References Cited

U.S. PATENT DOCUMENTS 6,249,992 B1 6/2001 Irving et al.
2014/0068975 A1 3/2014 Dubiel

FOREIGN PATENT DOCUMENTS

CN 201850533 U 6/2011
CN 201883406 U 6/2011
(Continued)

OTHER PUBLICATIONS

The World Intellectual Property Organization (WIPO) International Search Report for PCT/CN2015/070418 dated Apr. 17, 2015 pp. 1-8.

*Primary Examiner* — Tara Leigh Mayo-Pinnock
(74) *Attorney, Agent, or Firm* — Anova Law Group, PLLC

(57) ABSTRACT

A side snowplow including a land leveler, comprising: a rear mounted seat, a hydraulic cylinder I, a pull rod, a snow-pushing board, an oscillating rod, a hydraulic cylinder II, and a front mounted seat. The rear mounted seat is fixed on a rear portion of a rear rack of the land leveler and connected to the pull rod; the hydraulic cylinder I is hingedly connected to the rear mounted seat, and the pull rod; and the snow-pushing board is positioned at a left side or a right side of the land leveler and inclines toward a direction that the land leveler moves, a rear end of the snow-pushing board being
(Continued)

connected to the hinge plate II, a front end of the snow-pushing board being connected to the hinge plate III.

4 Claims, 3 Drawing Sheets

(56) References Cited

FOREIGN PATENT DOCUMENTS

| | | | |
|---|---|---|---|
| CN | 103061299 | A | 4/2013 |
| CN | 103343520 | A | 10/2013 |
| CN | 103967068 | A | 8/2014 |
| JP | 4535399 | B2 | 9/2010 |

SIDE SNOWPLOW INCLUDING LAND LEVELER

CROSS REFERENCE TO RELATED APPLICATIONS

This application claims priority to International Application No. PCT/CN2015/070418, filed on Jan. 9, 2015, which claims priority to Chinese Patent Application No. 201410124973.6, filed on Mar. 31, 2014, all of which are incorporated herein by reference in their entirety.

TECHNICAL FIELD

The present disclosure generally relates to the technical field including a snowplow apparatus applicable to engineering machinery and, more particularly, relates to a side snowplow including a land leveler.

BACKGROUND ART

Land levelers, when used as snowplow tools, may have the following features: being widely applicable, requiring relatively low working space, having relatively high working speed, having relatively strong adaptability. However, the snow plowing efficiency of a land leveler is lower than the snow plowing efficiency of a professional snowplow. A large professional snowplow is often expensive and is left unused for a long period of time during a year. Owning a professional snowplow can cause a waste of resources.

In recent years, land levelers are used more and more to remove snow. In some applications, a professional snow plowing device is used with a land leveler to remove snow. In some other applications, the blade of a snowplow is used directly to remove snow. Currently, various different snow plowing devices can be mounted on land levelers to remove snow. A snow plowing device may have a bar shape or a "V" shape. For example, a Chinese patent with the publication number CN103061299A discloses that, a snow plowing device is mounted on the front rack of a land leveler. As a result, a large overlapping area is formed between the snow-removing region and the blade. The actual plowing width of the land leveler is not expanded.

When removing accumulated snow, it is desired that the distance between the blade and the road surface is sufficiently close to ensure snow is properly removed. However, hard protrusions, e.g., cracking areas on the road surface, and protruded areas formed after road repair, can exist on the road surface, and those hard protrusions can cause significant damages to the blades. Such snow plowing method can also cause significant damages to the road surface.

It has been well known that, land levelers are mainly driven by a rear-wheel drive system. Because a land leveler often has a long body, 70% of its total weight is applied on the rear wheels of the land leveler. Such structure, which is light on the front portion and heavy on the rear portion of the body, can enable the land leveler to be more stable on wet roads. If a snow plowing device is mounted at the front portion of the land leveler, the center of gravity of the land leveler can shift closer to the front portion of the land leveler. Because of the wet icy roads, the land leveler is more susceptible to skidding and being unstable. Further, the snow plowing device mounted at the front portion of a land leveler may also block the driver's field of view.

INVENTION DISCLOSURE

Technical Solution

To solve the above technical problems in the conventional technology, the present disclosure provides a side snowplow including a land level. In a snow plowing process, the plowing width can be expanded for a single trip, and snow plowing process may be more efficient. Further, the disclosed side snowplow may be less susceptible to skidding on an icy road. The body of the disclosed side snowplow may be less susceptible to swaying. The driver's field of view would not be blocked such that it is easier for the driver to steer the side snowplow and avoid barriers on the road.

The present disclosure provides a side snowplow including a land leveler, including: a rear mounted seat, a hydraulic cylinder I, a pull rod, a snow-pushing board, an oscillating rod, a hydraulic cylinder II, and a front mounted seat. The rear mounted seat is fixed on a rear portion of a rear rack of the land leveler, the rear mounted seat being hingedly connected to a hinge plate I through pins. One end of the pull rod is hingedly connected to the hinge plate I through pins, and another end of the pull rod is hingedly connected to a hinge plate II through fixed pins. One end of the hydraulic cylinder I is hingedly connected to the rear mounted seat, and another end of the hydraulic cylinder I is hingedly connected to the pull rod. The front mounted seat is fixed on a front portion of the rear rack of the land leveler. One end of the oscillating rod is hingedly connected to the front mounted seat, and another end of the oscillating rod is hingedly connected to a hinge plate III through the pins. One end of the hydraulic cylinder II is hingedly connected to the front mounted seat, and another end of the hydraulic cylinder II is hingedly connected to the oscillating rod. The snow-pushing board is positioned at a left side or a right side of the land leveler and inclines toward a direction that the land leveler moves, a rear end of the snow-pushing board being connected to the hinge plate II, and a front end of the snow-pushing board being connected to the hinge plate III.

Advantageous Effects

The present disclosure includes several advantages.

Firstly, in conventional technology, the snow-pushing board is mounted on the front portion of a snowplow. Because the width of the front portion of the snowplow is limited, the width of the snow-pushing board is limited. In the present disclosure, the snow-pushing board may be mounted on the left side or the right side of a land leveler. The width of the snow-pushing board can be greatly increased. The snow-pushing board may incline to a front portion of the land leveler. During a snow plowing process, the plowing width can be expanded in a single trip, which allows the disclosed side snowplow to be used in various high-grade highways, airports, and urban and rural roads.

Secondly, the pull rod of the disclosed side snowplow may be contracted. During a snow plowing process, the land leveler may move forward. When the blade scratches a protruded stiff object on the road surface, the pull rod may retract such that the snow-pushing board may be raised up to cross the protruded portion. Thus, the pull rod may buffer the scratching, and reduce the damages on the blade and the road surface. The pull rod may also be used to avoid barrier objects.

Thirdly, the present disclosure may be entirely positioned at the left side or the right side of a land leveler such that the driver's field of view may not be blocked. The disclosed side snowplow may be mounted on the rear rack of the land leveler so that the center of gravity of the disclosed snowplow may not shift forward. The disclosed side snowplow may be less susceptible to skidding on an icy road. The body of the disclosed side snowplow may be less susceptible to swaying.

Fourthly, the lifting mechanism of the snow-pushing board in the disclosed side snowplow may have a compact, simple, and practical structure. A small moving distance of the cylinder may result in a relatively high lifting of the snow-pushing board. The blade may effectively avoid a barrier object.

Figure 1:
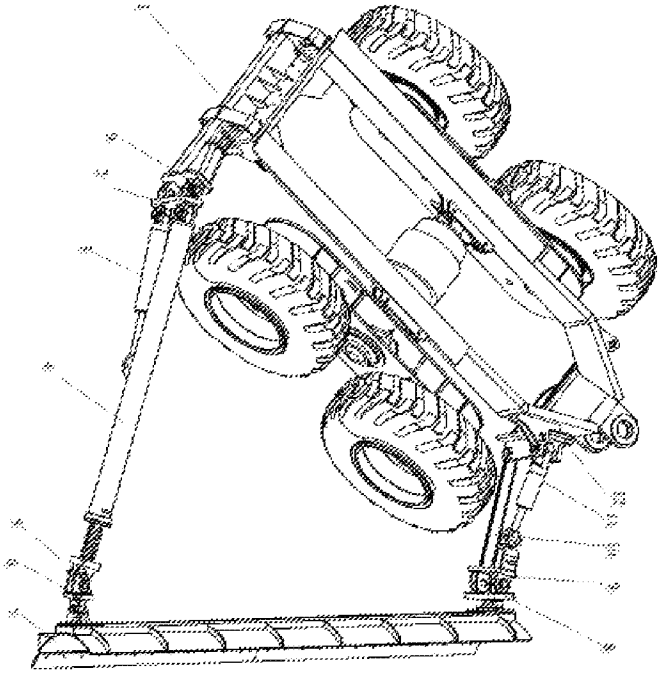
FIG. 1 illustrates an exemplary side snowplow consistent with various disclosed embodiments of the present disclosure.

In the drawings: 1. Rear Mounted Seat, 2. Hinge Plate I, 3. Hydraulic Cylinder I, 4. Pull Rod, 5. Fixed Pin, 6. Hinge Plate II, 7. Snow-Pushing Board, 8. Hinge Plate III, 9. Pin, 10. Oscillating Rod, 11. Hydraulic Cylinder II, 12. Front Mounted Seat, 13. Steel Tube, 14. Copper Sleeve, 15. Blocking Plate, 16. Bolt, 17. Blocking Pedestal, 18. Spring, 19. Sliding Rod, 20. Bushing, and 21. Fixing Base.

MODE FOR INVENTION

The present disclosure is now described in detail in connection with the drawings.

As shown in FIG. 1, the disclosed land leveler used for a side snowplow may include a rear mounted seat 1, a hydraulic cylinder I 3, a pull rod 4, a snow-pushing board 7, an oscillating rod 10, a hydraulic cylinder II 11, and a front mounted seat 12. The rear mounted seat 1 may be fixed at the rear portion of a rear rack of the land leveler. The rear mounted seat 1 may be hingedly connected to a hinge plate I 2 through a pin 9. On end of the pull rod 4 may be hingedly connected to the hinge plate I 2 through pins, and the other end of the pull rod 4 may be hingedly connected to a hinge plate II 6 through fixed pins 5. One end of the hydraulic cylinder I 3 may be hingedly connected to the rear mounted seat 1, and the other end of the hydraulic cylinder I 3 may be hingedly connected to the pull rod 4. The front mounted seat 12 may be fixed at the front portion of the rear rack of the land leveler. One end of the oscillating rod 10 may be hingedly connected to the front mounted seat 12, and the other end of the oscillating rod 10 may be hingedly connected to the hinge plate III 8 through pins 9. One end of the hydraulic cylinder II 11 may be hingedly connected to the front mounted seat 12, and the other end of the hydraulic cylinder II 11 may be hingedly connected to oscillating rod 10. The snow-pushing board 7 may be positioned on the left side or the right side of the land leveler. The snow-pushing board may incline to the direction the land leveler is moving forward. The rear portion of the snow-pushing board 7 may be connected to the hinge plate II 6, and the front portion of the snow-pushing board 7 may be connected to the hinge plate III 8.

Figure 2:
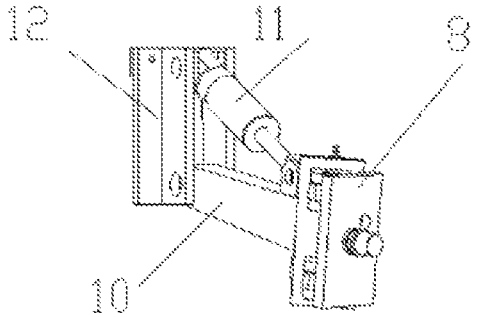
FIG. 2 illustrates an exemplary structure of a lifting mechanism of a snow-pushing board consistent with various disclosed embodiments of the present disclosure.

As shown in FIG. 2, the hinge plate III 8, the hinge pin 9, the oscillating rod 10, the hydraulic cylinder II 11, and the front mounted seat 12 may from a lifting mechanism provided by the present disclosure. A small moving distance of the cylinder may result in a relatively high lifting of the snow-pushing board. The blade may effectively avoid a barrier object.

Figure 4:
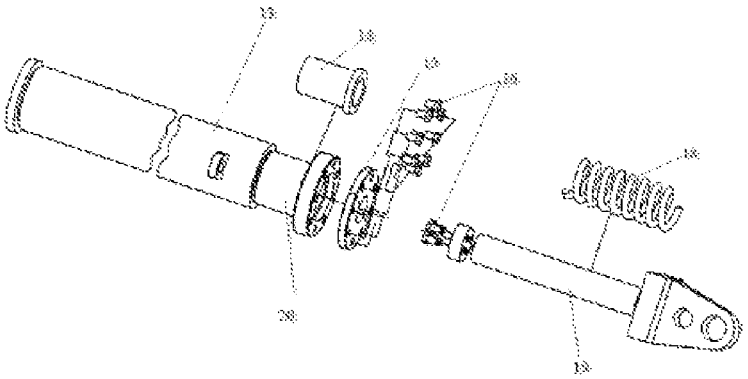
FIG. 4 illustrates an exploded view of a pull rod consistent with various disclosed embodiments of the present disclosure.

Further, as shown in FIG. 4, the pull rod 4 may include a steel tube 13, a copper sleeve 14, blocking plates 15, a blocking pedestal 17, and a sliding rod 19. One end of the copper sleeve 14 may include a protruded shoulder. The protruded shoulder may be used to mount two semicircular blocking plates 15. The semicircular blocking plates 15 may fix the copper sleeve 14 at an end portion of the steel tube 13 through bolts 16. The sliding rod 19 may pass through the copper sleeve 14 and slide in the steel tube 13. One end of the sliding rod 19 may include a blocking pedestal 17. The blocking pedestal 17 at one end of the sliding rod 19 may prevent the sliding rod 19 from sliding out of the copper sleeve 14.

Further, the sliding rod 19 may include a spring 18. The spring 18 may be compressed between the steel tube 13 and the sliding rod 19. When the snow-pushing board 7 scratches a protruded stiff object on the road surface, the sliding rod 19 may slide in the steel tube 13, and the spring 18 may be compressed. The spring 18 may buffer the scratching between the snow-pushing board 7 and the road surface.

Figure 5:
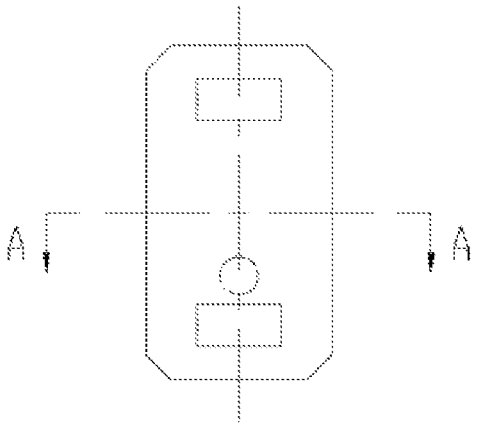
FIG. 5 illustrates a front view of a hinge plate III consistent with various disclosed embodiments of the present disclosure.
Figure 6:
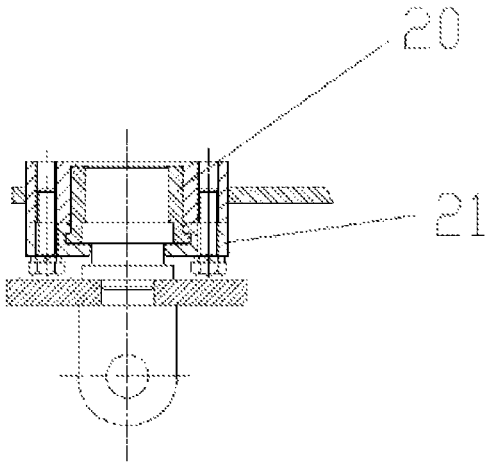
FIG. 6 illustrates a cross-sectional view of the hinge plate along an A-A direction in FIG. 5 consistent with various disclosed embodiments of the present disclosure.

As shown in FIGS. 5 and 6, further, pins may be soldered on the hinge plate III 8. The snow-pushing board 7 may be hingedly connected to the hinge plate III 8 through the bushing 20 and a fixing base 21. The snow-pushing board 7 may rotate up and down about the pins on the hinge plate III 8 to adjust the angle of the snow-pushing board 7. Thus, the snow-pushing board 7 may be moved up as shown in FIG. 3 or moved down as shown in FIG. 1.

Further, the hinge plate II 6 may be configured with two fixed pins 5 to prevent the snow-pushing board 7 from swaying.

Figure 3:
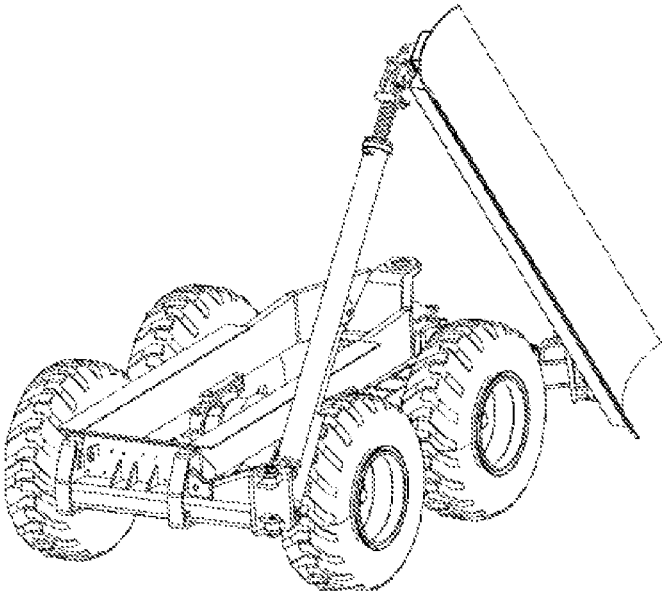
FIG. 3 illustrates an exemplary collapsed snow-pushing board consistent with various disclosed embodiments of the present disclosure.

The operation of the side snowplow may be described as follows: as shown in FIGS. 1 and 3, when the land leveler is moving forward, the hydraulic cylinder I 3 may extend and the hydraulic cylinder II 11 may retract. The pull rod 4 and the oscillating rod 10 may be raised up to lift the snow-pushing board 7 off the ground and avoid barrier objects. When in operation, the hydraulic cylinder I 3 may retract and the hydraulic cylinder II 11 may extend. The pull rod 4 and the oscillating rod 10 may move towards the ground such that the snow-pushing board 7 may land on the ground and perform snow plowing.

What is claimed is:

1. A side snowplow including a land leveler, comprising:

a rear mounted seat, a hydraulic cylinder I, a pull rod, a snow-pushing board, an oscillating rod, a hydraulic cylinder II, and a front mounted seat, wherein:

the rear mounted seat is fixed on a rear portion of a rear rack of the land leveler, the rear mounted seat being hingedly connected to a hinge plate I through pins;

one end of the pull rod is hingedly connected to the hinge plate I through pins, and another end of the pull rod is hingedly connected to a hinge plate II through fixed pins;

one end of the hydraulic cylinder I is hingedly connected to the rear mounted seat, and another end of the hydraulic cylinder I is hingedly connected to the pull rod;

the front mounted seat is fixed on a front portion of the rear rack of the land leveler;

one end of the oscillating rod is hingedly connected to the front mounted seat, and another end of the oscillating rod is hingedly connected to a hinge plate III through the pins;

one end of the hydraulic cylinder II is hingedly connected to the front mounted seat, and another end of the hydraulic cylinder II is hingedly connected to the oscillating rod; and the snow-pushing board is positioned at a left side or a right side of the land leveler and inclines toward a direction that the land leveler moves, a rear end of the snow-pushing board being connected to the hinge plate II, a front end of the snow-pushing board being connected to the hinge plate III, wherein the pull rod comprises: a steel tube, a copper sleeve, blocking plates, a blocking pedestal, and a sliding rod, wherein:

one end of the copper sleeve includes a protruded shoulder, the protruded shoulder being configured with two blocking plates that are semicircular, the blocking plates fix the copper sleeve at an end of the steel tube through bolts; and the sliding rod passes through the copper sleeve and slides in the steel tube, the blocking pedestal being configured at one end of the sliding rod to prevent the sliding rod from sliding out of the copper sleeve.

2. The side snowplow including the land leveler according to claim 1, wherein pins are soldered on the hinge plate III, and the snow-pushing board is hingedly connected to the pins of the hinge plate III through a bushing and a fixing base.

3. The side snowplow including the land leveler according to claim 1, wherein the hinge plate II is configured with two fixed pins.

4. The side snowplow including the land leveler according to claim 1, wherein the sliding rod is configured with a spring capable of being compressed between the steel tube and the sliding rod, wherein when the snow-pushing board is pressed with a force, the sliding rod slides in the steel tube and the spring is compressed to buffer the force.

* * * * *